US006158835A

United States Patent [19]

Jackson et al.

[11] Patent Number: 6,158,835

[45] Date of Patent: Dec. 12, 2000

[54] NOZZLE USAGE BALANCING FOR INK-JET PRINTERS

[75] Inventors: Lee W Jackson, Vancouver; Kevin R Hudson, Camas; Mark D Lund, Vancouver, all of Wash.

[73] Assignee: Hewlett-Packard Company, Palo Alto, Calif.

[21] Appl. No.: 09/228,000

[22] Filed: Jan. 8, 1999

[51] Int. Cl.[7] ..... B41J 29/38

[52] U.S. Cl. ..... 347/12; 347/40; 400/124.07

[58] Field of Search ..... 347/40, 41, 5, 347/9, 12, 37, 16; 358/1.11; 400/124.07, 323

[56] References Cited

U.S. PATENT DOCUMENTS 5,044,796 9/1991 Lund ..... 400/323
5,429,441 7/1995 Schulz et al. .
5,512,923 4/1996 Bauman .
5,640,183 6/1997 Hackleman ..... 347/40

FOREIGN PATENT DOCUMENTS 253 200 1/1988 European Pat. Off. .
0 532 270 A2 3/1993 European Pat. Off. ..... B41J 2/07

OTHER PUBLICATIONS

Copending application No. 08/490,268.

*Primary Examiner*—David F. Yockey

[57] ABSTRACT

Printhead longevity is extended by more uniformly utilizing individual printhead printing elements. A preferred algorithm moves an active zone of printing elements uniformly down the printhead on successive print passes. If insufficient printing elements are available to print the next pass, the active zone is moved to a point near the top of the printhead determined by a modulo function.

15 Claims, 6 Drawing Sheets

NOZZLE USAGE BALANCING FOR INK-JET PRINTERS

FIELD OF THE INVENTION

The present invention relates to printing systems, and more particularly relates to techniques for extending the longevity of printheads used in such systems (e.g. ink jet printheads).

BACKGROUND AND SUMMARY OF THE INVENTION

Ink jet printers are well known and widely used. Such printers typically incorporate a scanning carriage which supports one or more inkjet printheads. Thermal inkjet printheads operate by rapidly heating a small volume of ink to cause the ink to vaporize and be ejected through one of plural orifices or nozzles so as to print a dot of ink on a recording medium, such as a sheet of paper. Typically, the orifices are arranged in one or more linear arrays on a nozzle plate. The properly sequenced ejection of ink from each orifice causes characters or other images to be printed on the paper as the printhead is moved relative to the paper. One type of thermal printhead is described in U.S. Pat. No. 5,278,584 assigned to the present assignee and incorporated herein by reference.

A related type of ink jet printer uses piezo-electric elements, instead of heaters, to eject ink from an associated orifice. The present invention applies to both thermal and nonthermal ink jet printers.

One drawback of inkjet printers is that the ink ejection elements, whether heater resistors or piezoelectric elements, and their associated nozzles, wear unevenly due to nonuniform use of the various ink ejection elements and nozzles in the scanning printhead. This nonuniform use, or "nozzle affinity," can be measured over the course of printer output (e.g. a page, a document, etc.) and is expressed as a ratio. Nozzle affinity is the ratio of the number of dots printed by the most active nozzle, to the average number of dots printed by all the nozzles. Thus, if one nozzle prints 4800 dots in a sample output, while the average nozzle prints 1200 dots, the nozzle affinity is 4.0. Nozzle affinities in the prior art generally range from about 2.0 to 6.0, with the greatest imbalances being associated with documents of regularly-spaced text.

Although a printhead may have hundreds of nozzles, replacement is usually required when one nozzle (or a few) fails. Accordingly, it will be recognized that the useful lifetime of a printhead can be extended considerably (e.g. by factors or two or more) if the nozzle affinity ratio can be reduced. So doing reduces wear on the most active nozzle—the nozzle most prone to failure.

A prior art approach to reducing nozzle affinity is disclosed in a copending application by Nobel et al, Ser. No. 08/490,268, filed Jun. 14, 1995, entitled Inkjet Printing With Uniform Wear of Ink Ejection Elements and Nozzles, assigned to the present assignee and incorporated by reference. Referring to FIG. 1, Nobel's preferred embodiment does not consistently align the top 12 of the printhead 14 with the top of a swath of text to be printed, as was conventionally done in the prior art (FIG. 1 at 'A'). Instead, Nobel et al sometimes aligns the bottom 16 of the printhead with the bottom of the swath of text so as to even out the nozzle usage (FIG. 1 at 'B'). This arrangement causes nozzles that previously aligned with spaces between text lines to sometimes align with printable text, so as to even out nozzle usage. However, significant usage disparities can still exist (e.g. in FIG. 1 example, alternating between printhead placements A and B still leaves a quarter of the printhead nozzles unused, namely at areas 18 and 20.) Nobel et al discloses variant nozzle balancing techniques as well.

The present invention extends and improves the nozzle balancing techniques disclosed by Nobel et al.

The following disclosure proceeds with reference to an exemplary single-color (e.g. black ink) printhead having 304 nozzles, arrayed in two staggered columns of 152 nozzles each. The vertical spacing between nozzles in each column is $1/300^{th}$ of an inch. The vertical spacing between successive nozzles in the staggered columns is thus $1/600^{th}$ of an inch. (It will be recognized that the foregoing printhead is exemplary only. The invention can similarly be practiced with color printheads, multi-color printheads, printers employing plural distinct printheads, etc.) For purposes of the present disclosure, the printhead nozzles are numbered consecutively beginning at the top, with the odd-numbered nozzles in one column, and the even-numbered nozzles in the other.

The present disclosure sometimes refers to the printhead travelling down the piece of paper, from top to bottom. Of course, in most printers the printhead moves only laterally, and the paper moves in the other dimension. However, conceptualization of a raster-scanning printhead that moves both down and across the paper is sometimes convenient.

By way of further background, it is helpful to detail certain nuances of printer operation that may be taken into account in addressing the nozzle affinity problem.

In the prior art, certain Hewlett-Packard Co. printers have employed multi-pass printing techniques to increase print quality when several passes of the printhead over a swath are required. (Some high quality printing modes entail eight passes.) In particular, such multi-pass algorithms seek to print successive passes using different groups of printhead nozzles. For example, in a high quality black text print mode where two passes over a swath of text are required, the first pass may employ nozzles 101–200, and—after moving the printhead down slightly—the second pass may employ nozzles 1–100. By this arrangement, any nozzle irregularities (e.g. light or no output) are masked by subsequent passes, rather than compounded.

Another technique for optimizing print quality is to avoid printing fractional lines of text (i.e. tops of characters in one pass; bottoms on next pass). If a line is split, columns of dots from one pass may not precisely align with columns of dots from the second pass, causing a discontinuity, or "jitter," in the characters, mid-line.

The foregoing problem of apparent discontinuities at vertical swath boundaries cannot be avoided when printing graphics (or text) taller than the printhead. To mitigate such discontinuities, however, the normal bidirectional mode of printing (printing during both the left-to-right and right-to-left movements of the printhead) is commonly suspended, and unidirectional printing is employed instead. Unidirectional printing provides more consistent droplet placement—swath to swath—than bidirectional printing.

Discontinuity errors that still persist with unidirectional printing can be obscured by use of multi-pass printing techniques. Consider the printing of a graphical image that is 2 printheads (i.e. 608 droplets) in height, and requires four passes of the printhead over each swath. One approach is to use the full height of the printhead four times along one swath, advance the paper once, and then use the full height of the printhead four times at the adjoining swath. Such action effectively reforms the same boundary four times, emphasizing same and increasing its visibility.

Printers using HP's multi-pass print techniques proceed differently. An exemplary printing procedure might divide the 608 lines of droplets into eight fractional swaths A–H, which are printed in eleven successive unidirectional passes, with the paper advanced between each, as shown in FIG. 2. Each fractional swath is printed four times (e.g. swath B is printed in passes 2, 3, 4 and 5). By this arrangement, any discontinuity introduced by column misalignment where the top and bottom edges of the printhead adjoin (e.g. boundary AB in FIG. 2, where passes 1 and 5 adjoin) is obscured by multiple overprinted swaths that have no boundary in this region (e.g. passes 2, 3, and 4).

To provide maximum flexibility for multi-pass printing, it is desirable to print text with the bottom-most nozzles on a printhead. The reason for this will be apparent from FIG. 3, which shows a line of text above a large graphic.

If the printhead (the small rectangle) is positioned at "A," then the line of text can be printed without limiting the print options for the following graphic. The multi-pass arrangement shown in FIG. 2 can be employed. If, however, the printhead is positioned at "B" to print the text, much-needed flexibility is lost for printing the graphic. This is because most printer platens cannot move the paper in reverse. The top line of the graphic will be printed with a nozzle near the top of the printhead. The shingling of FIG. 2, with different quarters of the printhead employed to print different of the successive print passes, cannot be achieved. For this reason, it is generally desirable to advance the paper as little as possible, so as to keep the lower nozzles available to start multi-pass graphics printing when needed.

Returning to the nozzle affinity problem discussed earlier, a preferred embodiment of the present invention addresses this issue by successively shifting the zone of active print nozzles up (or down) the printhead by a uniform increment in successive print swaths. By this arrangement, all nozzles are utilized, redressing the problem of idle nozzles that persists in the prior art.

The foregoing and additional features and advantages of the present invention will be more readily apparent from the following detailed description, which proceeds with reference to the accompanying drawings.

DETAILED DESCRIPTION

Figure 1:
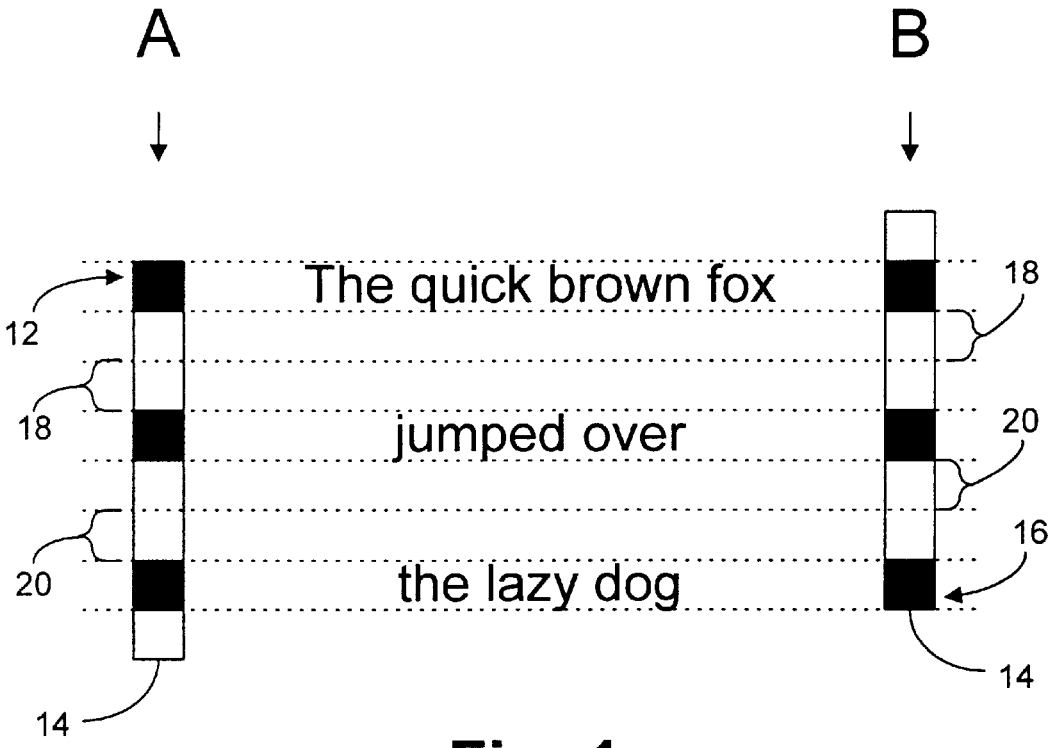
Fig. 1 Prior Art
FIG. 1 is a diagram showing operating of a prior art nozzle balancing technique.
Figure 2:
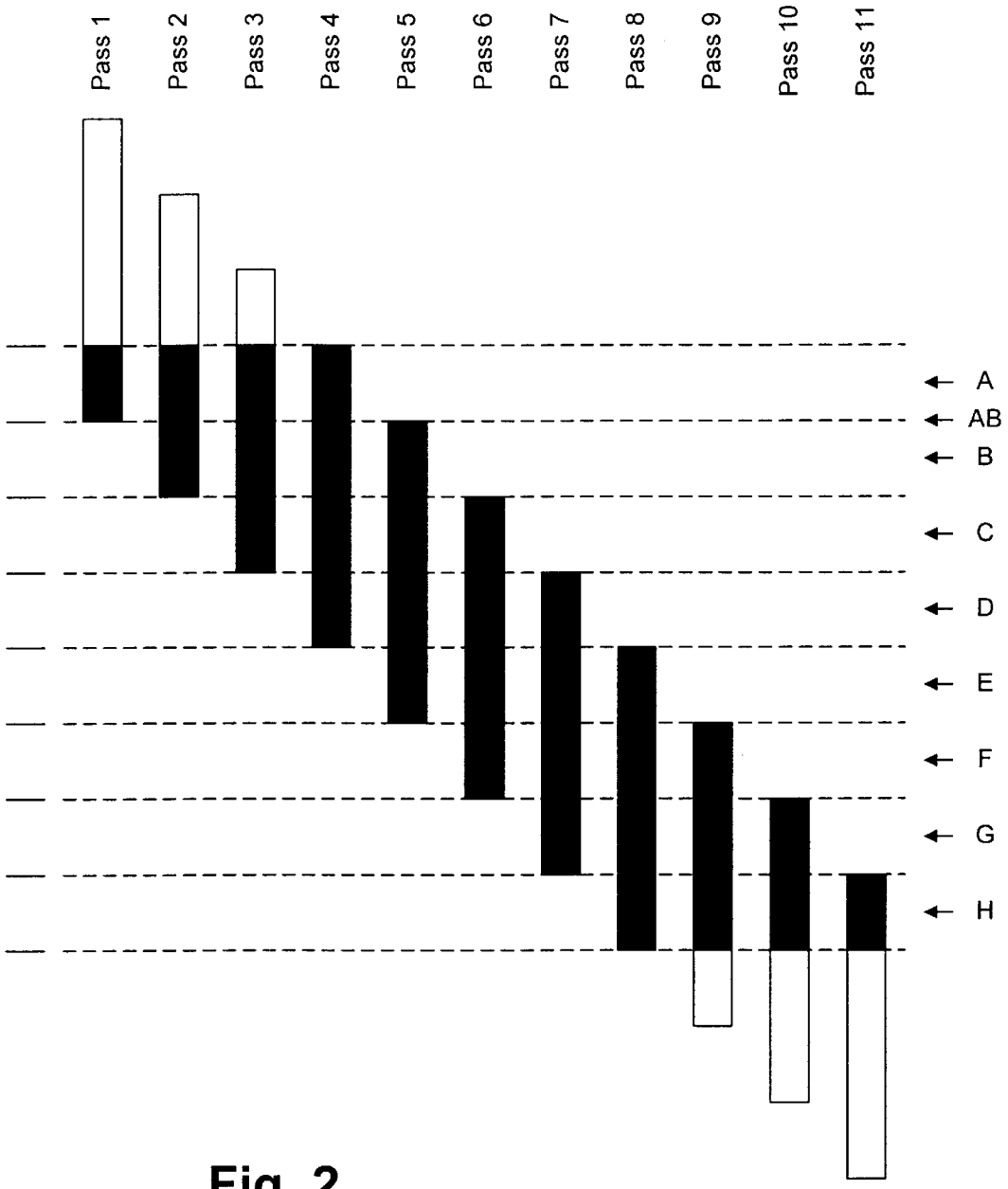
Fig. 2 Prior Art
FIG. 2 is a diagram showing an application of prior art multi-pass printing technology.
Figure 3:
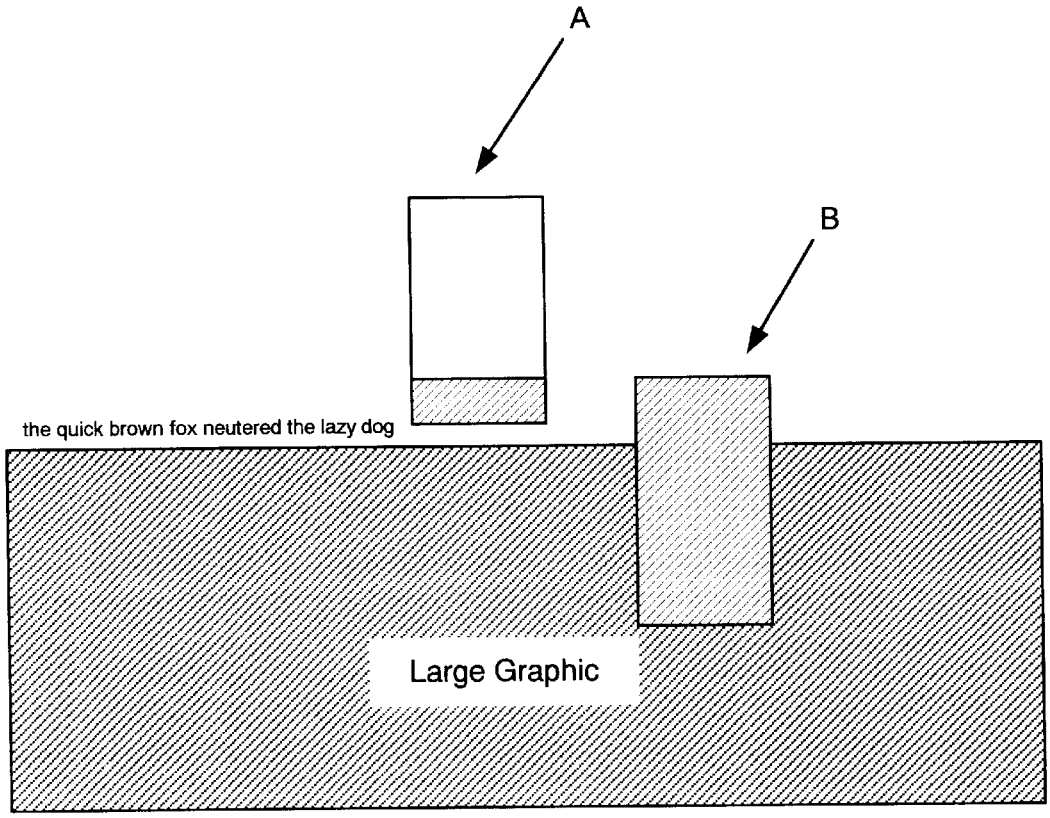
FIG. 3 shows why application of prior art multi-pass printing technology generally ends to favor the bottom nozzles on a printhead.
Figure 4A:
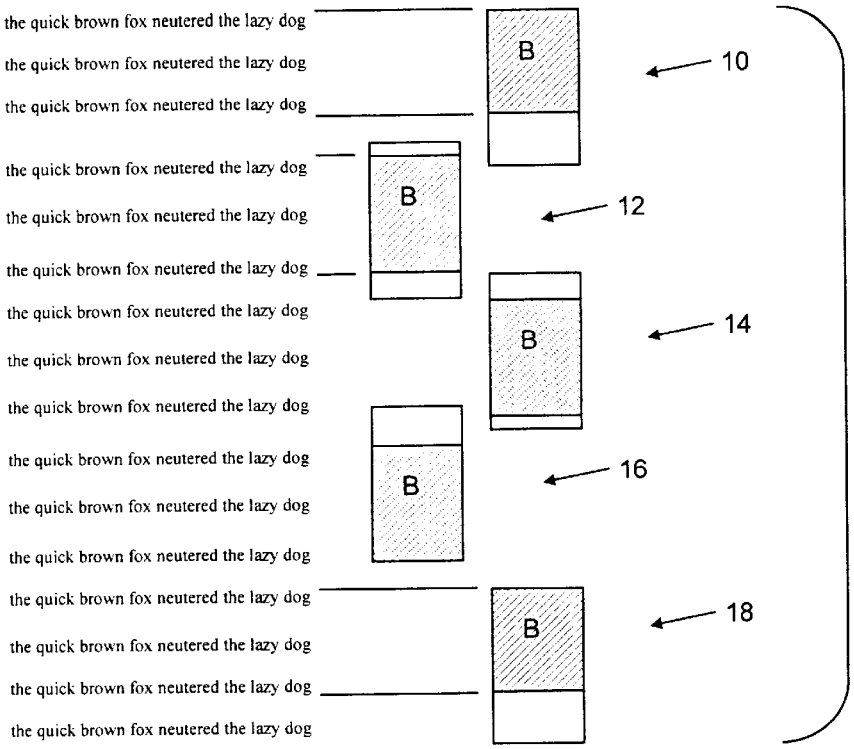
FIGS. 4A and 4B are diagrams showing operation of a nozzle balancing technique used in an illustrative embodiment the present invention.

FIG. 4A shows a sample of printed text, and the movement of a printhead (indicated by the rectangles) down the page to print same, in accordance with one embodiment of the present invention.

The shaded regions in the printheads indicate the zones of "active" print nozzles. (It will be recognized that "active" does not mean that the nozzles are used on a given print pass. Rather, this term serves to identify the contiguous grouping of nozzles that spans all of the nozzles that are used in a print pass.) The letter "B" indicates that bidirectional printing is used.

Printing begins with the printhead at position 10. The top of the printhead is aligned with the top of the first line of text. (These lines are approximately "10 point" size, and are regarded as uniformly sized.) Although the bottom of the printhead extends into the fourth line of text, it does not completely encompass the fourth line. Accordingly, to avoid jitter, only the first three lines of text are printed in the first print swath. Print nozzles overlying the fourth line of text are idle.

The printhead next advances down the paper to position 12 and prints the fourth through sixth lines of text. Note that the zone of active print nozzles is shifted down the printhead, with idle nozzles at both the top and bottom of the printhead. The amount of this shift is substantially constant in the illustrated embodiment, as detailed below.

In comparing the relative positions of the printhead at positions 10 and 12, it will be noted that (1) some idle nozzles at the bottom of the printhead in position 10 are not overlaid by any nozzles in position 12; (2) other idle nozzles at the bottom of the printhead in position 10 are overlaid by idle nozzles in position 12; and (3) still other idle nozzles at the bottom of the printhead in position 10 are overlaid by active nozzles in position 12.

To print the seventh through ninth lines of text, the printhead is moved to position 14. Again, the zone of active print nozzles is shifted down the printhead, by the same amount as before. Again, there are idle nozzles at both the top and bottom of the printhead.

To print the $10^{th}$ through $12^{th}$ lines of text, the printhead is moved to position 16. Again, the zone of active print nozzles is shifted down the printhead by the same amount as before. Now, however, the active zone extends to the bottom of the printhead.

In comparing the relative positions of the printhead at positions 14 and 16, it will be recognized that they bear certain similarities to the relationships between positions 10 and 12. Some idle elements at an edge of the printhead in one position overlie no nozzles when the printhead is in the other position. Other idle elements at the same edge of the one printhead position overlie idle nozzles when the printhead is in the other position. And still other idle elements at the same edge of the one printhead position overlie active nozzles when the printhead is in the other position.

To print the $13^{th}$ through $15^{th}$ lines of text, the printhead is moved to position 18. Since the zone of active print nozzles was already at the bottom of the printhead at position 16, it cannot move further down. Instead, the active print zone moves to the top of the printhead, similar to position 10. (As detailed below, it is rare that the active print zone moves fully to the top of the printhead. More typically, the active print zone is placed away from the top of the printhead, e.g. by a modulo function, when there are insufficient idle nozzles at the bottom of the printhead.)

Note that the text lines are spaced so that the printhead, in position 18, could print a fourth line of text (the $16^{th}$) in the same swath. However, no such printing occurs in accordance with the preferred printing algorithm, discussed below. Instead, that line is printed by the printhead in a subsequent position (not shown). (This results in a decrease in throughput, but can provide other benefits.)

Figure 4B:
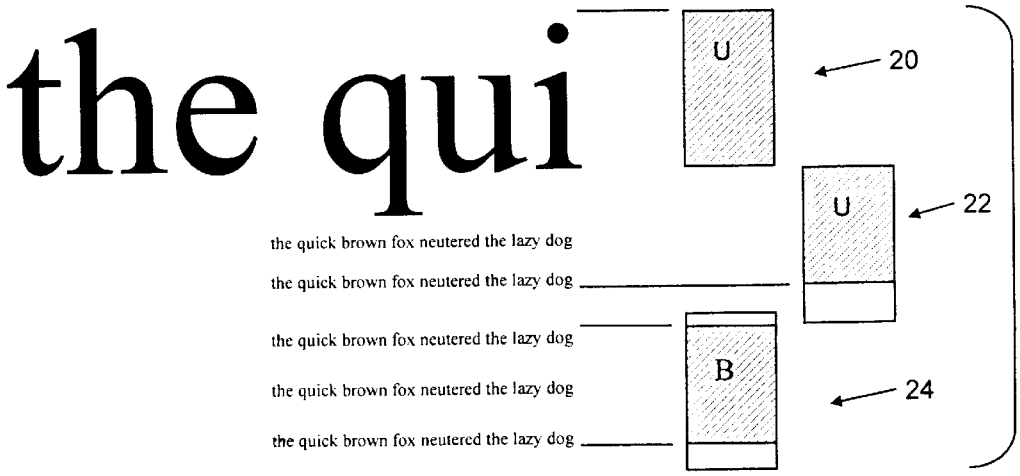

FIG. 4B is another example of printing in accordance with the preferred embodiment. The "U" indicates unidirectional printing; the "B" again indicates bidirectional printing.

In this example, the first line of text is taller than the printhead. In the first print swath 20, the whole height of the printhead is thus used to print the upper portion of the characters. Then, to print the lower portion of the characters (the "descenders") with minimum jitter, the second swath 22 is printed in the same direction. This second swath 22 also prints the second and third lines of text. The bottom nozzles are idle in this second swath.

It will be recognized that the printhead position in the second swath 22 could be elevated from that shown, with idle nozzles at both the top and bottom of the printhead. The illustrated positioning is in accordance with the algorithm described below, but could be different in other embodiments.

To print the $4^{th}$ through $6^{th}$ lines in FIG. 4B, the printhead is moved to position 24. The zone of active print nozzles is moved down the printhead by the same amount as before.

(Print pass 24 resumes the usual bidirectional mode of printing, since the blank interline area obviates any concern about visible jitter.)

(For clarity of illustration, FIGS. 4A and 4B show the active zone shifting in large increments (e.g. dozens of nozzles). More typically the active zone shifts—from swath to swath—in increments of just one nozzle. Similarly, FIGS. 4A and 4B generally show uniformly-sized active print zones. More typically, the size of the active print zone (swath height) changes considerably from swath to swath. Finally, FIG. 4A shows the active print zone sometimes extending to the bottom (16) and top (18) of the printhead. As detailed below, such placement is unusual.)

The positioning of the active zone on the printhead will become clearer by consideration of the algorithm used to balance nozzle usage. This algorithm takes advantage of the fact that print data (e.g. text) can be printed bidirectionally if the data is both preceded and followed by at least one blank raster. (A raster is a line width corresponding to a single print nozzle.) The blank raster(s) means that there will generally be one or more idle nozzles on a print pass. This permits nozzle usage to be better balanced by shifting the data on the printhead, and modifying the page position of the printhead, so that the data on sequential print passes are cycled through all combinations of available nozzles.

Cycling here refers to the manner in which the shift of the active print zone is determined. In the preferred embodiment the shift amount (ShiftAmount, i.e. the offset of the top of the active zone from its initial position near (sometime at) the top of the printhead) is incremented on successive bidirectional print passes until it reaches a practical limit (ShiftLimit), at which time it is reset to zero. Expressed otherwise:

```
0<=ShiftAmount<=ShiftLimit
```

In the illustrated embodiment, two factors are considered in selecting ShiftLimit. First, ShiftLimit should not be substantially smaller than typical print swaths to prevent a usage bias toward one end of the printhead. Values of ShiftLimit equivalent to about 1 line of 10 point text (75 nozzles, in the exemplary printhead detailed above) seem to work well in the illustrated embodiment.

The second factor affecting the choice of ShiftLimit is the ability to transition to shingled printing. When a large shift amount is applied to a very small swath, it can cause the paper to be advanced so far that it is not possible to properly enter an immediately following shingled region.

Since the number of trailing blank nozzles will (in general) vary, the actual shift amount will have to be prematurely "clipped" in some cases. The clipping function is:

```
If(ShiftAmount>TrailingBlankNozzles)
{
  ActualShiftAmount=(ShiftAmount
    %TrailingBlankNozzles)
}
```

where the operator '%' indicates a modulo function. For example, in a printhead with 304 nozzles, a ShiftAmount that has been incremented to 60, and 250 nozzles needed to print the next pass, the active print zone is cycled up to the top of the printhead, beginning at nozzle 49. (TrailingBlankNozzles=304−250=54; ActualShiftAmount=60 mod 54=6. Beginning Nozzle=TrailingBlankNozzles−Actual ShiftAmount+FirstPrintheadNozzle=54−6+1=49.)

Figure 5:
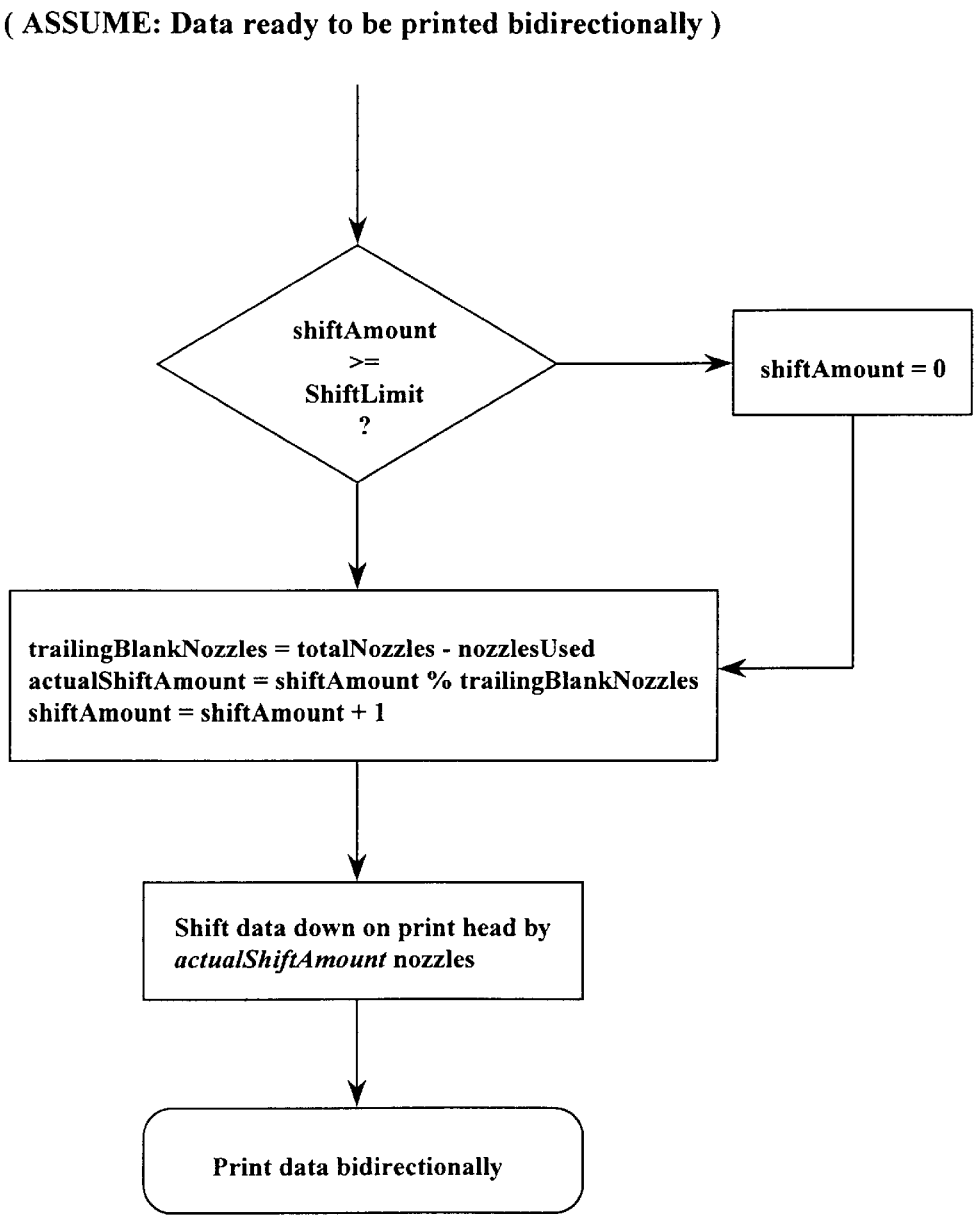
FIG. 5 is a flow chart detailing an algorithm used in the FIG. 4 embodiment.

This algorithm is graphically depicted in FIG. 5.

Note that ShiftAmount is not itself modified by the clipping, but is allowed to increase until it reaches ShiftLimit. This is so the actual shift amounts will not be skewed to the low end (as would happen with a simple clipping function), and this arrangement also adds a measure of randomness to the shifting (if the text spacing has an element of randomness). Also note that relative performance is maximized, since ActualShiftAmount is calculated after the optimum print pass parameters have been determined (i.e., bidirectional mode and number of active nozzles).

One reason the above-described arrangement is desirable is that active zone placement is adaptively determined based on the page characteristics (e.g. swath heights, interline blanks, etc.) While this sometimes results in a seemingly-random placement of the active zone on the printhead, in fact it is not random—it is deterministic. In contrast, the prior art approaches did not adapt to such page characteristics, but rotely placed the active zone based on a predetermined—or purely random-basis.

The detailed algorithm is illustrative only; other algorithms can alternatively be employed. For example, the shift amount can be adaptively selected based on the size of text being printed.

The following table shows the results of the foregoing nozzle balancing technique applied to different test documents. The "Baseline" column numbers are nozzle affinity ratios obtained without cycling; "Balanced" numbers are after the above-described cycling algorithm was implemented.

| Document | Baseline | Balanced |
|---|---|---|
| Simple Letter | 5.8 | 2.7 |
| Technical Report | 3.1 | 2.5 |
| Letter with graphics | 3.4 | 2.7 |
| Color letter #1 | 2.0 | 1.9 |
| Color letter #2 | 4.3 | 1.4 |
| Weighted Average | 4.4 | 2.1 |

Figure 6:
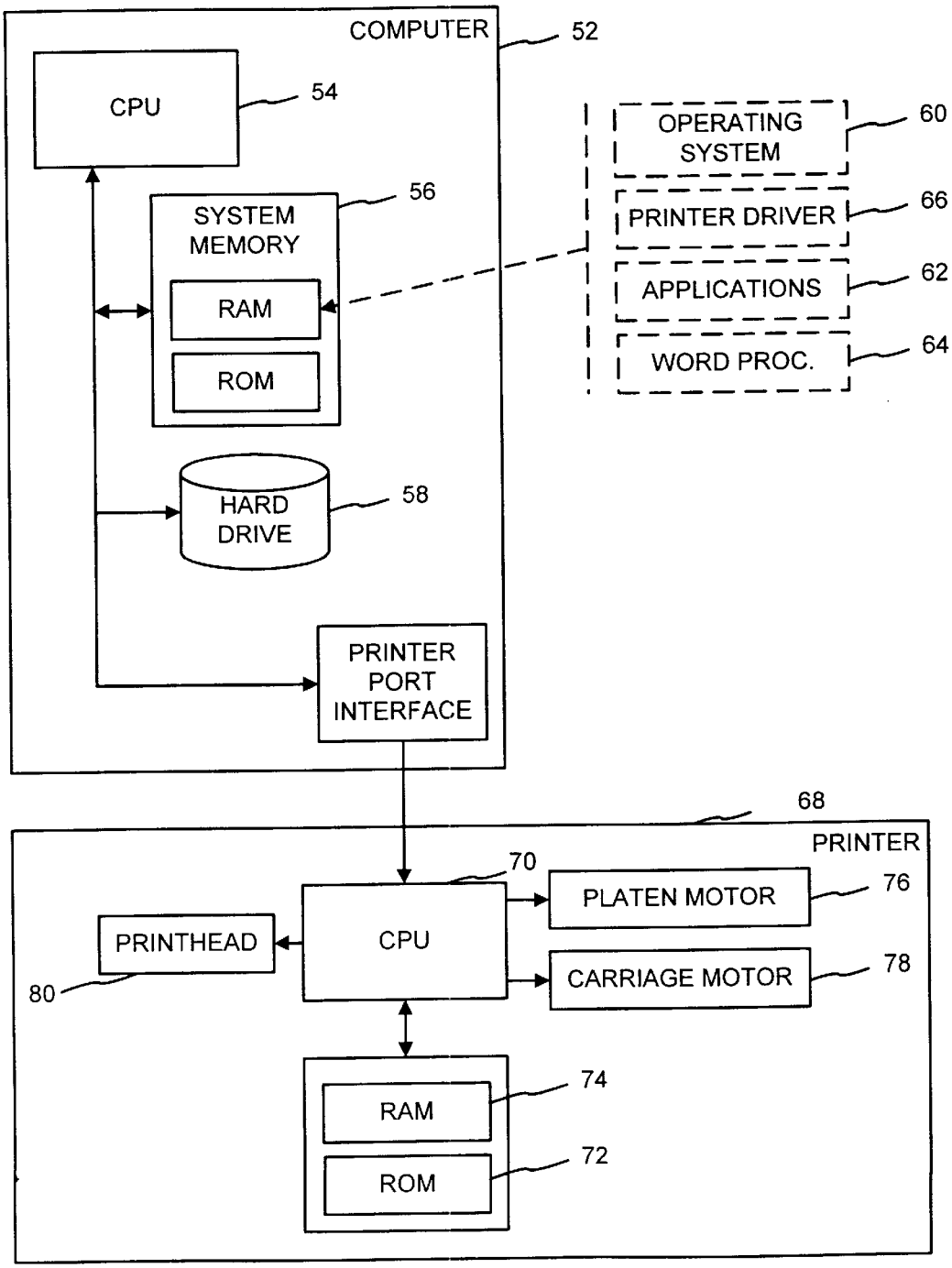
FIG. 6 is a block diagram of a printing system employing the techniques of FIGS. 4 and 5.

An exemplary printing system using the above-described methods is shown in FIG. 6 and includes a computer 52 and a printer 68. The computer 52 is conventional and includes a CPU 54, memory 56, mass storage 58, etc. Included in the memory is an operating system 60 and various application programs 62, such as a word processing program 64. Included with the operating system is printer driver software 66. The printer driver accepts output data from the application programs and converts it to the signals expected by the printer 68.

The printer 68 is also conventional and includes a CPU 70, ROM memory 72, and RAM memory 74. The CPU controls a platen motor 76 (controlling paper movement)

and a printhead carriage motor 78 (controlling lateral movement of the printhead). The CPU also controls the firing of the nozzles of the printhead 80. All of these CPU operations are performed in accordance with firmware instructions stored in the ROM memory 72, responsive to data provided by the printer driver software 66.

The nozzle usage balancing techniques detailed above can be implemented by appropriate computer instructions forming part of the printer driver software 66, or by the printer firmware (stored in ROM memory 72).

Having described the principles of our invention with reference to a preferred embodiment, it should be apparent that the invention can be modified in arrangement and detail without departing from such principles. For example, while the illustrated embodiment shifted the active zone of print nozzles down the printhead in steps of one, other increments, or the opposite shift direction, can alternatively be used. Similarly, while the illustrated embodiment moved the active zone of print nozzles after each printing pass, the zone can be moved less frequently.

In more complex embodiments, a memory—either in the printer housing or associated with the printhead—can track the number of droplets fired by each printhead orifice over some period (e.g. lifetime, last ten pages, etc.). Based on this actual usage data, the size and location of the active print zone can be selected to equalize nozzle usage.

Many other such variations will be apparent to those skilled in the art.

In view of the many embodiments to which the principles of our invention can be applied, it should be understood that the detailed embodiment is exemplary only and should not be taken as limiting the scope of our invention. Rather, we claim as our invention all such embodiments as may fall within the scope and spirit of the following claims, and equivalents thereto.

We claim:

1. A method of balancing usage of printing elements in a printhead, the method including:

identifying, for each of plural print swaths, a size of a zone of the printing elements needed to print said swath; and on successive print swaths, positioning an active zone of said identified size at successively displaced positions from a first end of the printhead for printing;

wherein said successive displacement of the active zone tends to equalize usage of said printing elements;

and wherein, if an insufficient number of non-active printing elements remain to position the active zone for a next print swath at a next successively displaced position, the position of the active zone is recycled back to near the first end of the printhead, where said recycling does not always position an end of the active zone at a predetermined position.

2. The method of claim 1 in which said recycling is performed in accordance with a modulo function.

3. The method of claim 1 in which the position to which the active zone is recycled depends, at least in part, on the number of said insufficient non-active printing elements.

4. The method of claim 1 in which the position to which the active zone is recycled depends, at least in part, on a size of the active zone of printing elements needed to print said next swath.

5. The method of claim 4 in which the position to which the active zone is recycled depends, at least in part, on the number of said insufficient non-active printing elements.

6. The method of claim 1 in which said positioning comprises shifting an end of the active zone by a uniform number of printing elements on successive print passes.

7. The method of claim 1 applied to printing an excerpt consisting of uniformly-sized characters and blank uniformly-sized inter-line regions.

8. A computer medium having stored therein instructions causing a printer to perform the method of claim 1.

9. A method of balancing usage of printing elements in a printhead, the method including:

identifying, for each of plural print swaths, a size of a zone of the printing elements needed to print said swath;

positioning an active zone of one of the identified sizes on the printhead for printing each of the plural print swaths, wherein said positioning includes occasionally shifting the active zone successively further away from a first end of the printhead; and if one of said occasional shifts would result in positioning of the active zone partially off the printhead, then recycling the position of the active zone back to near the first end of the printhead, where said recycling does not always position an end of the active zone at a predetermined position.

10. The method of claim 9 in which said occasional shifting comprises periodically shifting.

11. The method of claim 9 in which said occasional shifting comprises shifting for each successive print swath.

12. The method of claim 9 in which each of said occasional shifts comprises shifting by a uniform number of printing elements.

13. The method of claim 9 applied to an excerpt consisting of uniformly-sized characters and blank uniformly-sized inter-line regions.

14. A computer medium having stored therein instructions causing a printer to perform the method of claim 9.

15. In a method of printing text on a recording medium, the text including alternating lines of characters and blank inter-line regions, the method including providing a printhead having plural printing elements, and assigning plural lines of characters to be printed by said printhead in a single swath, an improvement comprising assigning N complete lines of characters to be printed by said printhead in a single swath, even though the printhead is large enough to print M complete lines of characters in a single swath, where N is less than M.

* * * * *